US006783024B2

(12) United States Patent
Lee

(10) Patent No.: US 6,783,024 B2
(45) Date of Patent: Aug. 31, 2004

(54) SPOUT ASSEMBLY FOR THIN-FILM LIQUID CONTAINER

(76) Inventor: Jung Min Lee, 1208 Misung Apt. A-dong, 37 Yeoueudo-dong, Youngdungpo-gu, Seoul 150-010 (KR)

( * ) Notice: Subject to any disclaimer, the term of this patent is extended or adjusted under 35 U.S.C. 154(b) by 0 days.

(21) Appl. No.: 10/275,232

(22) PCT Filed: May 8, 2001

(86) PCT No.: PCT/KR01/00740

§ 371 (c)(1),
(2), (4) Date: Nov. 4, 2002

(87) PCT Pub. No.: WO01/98167

PCT Pub. Date: Dec. 27, 2001

(65) Prior Publication Data

US 2003/0075560 A1 Apr. 24, 2003

(30) Foreign Application Priority Data

May 8, 2000 (KR) ..... 10-2000-0024507
Jul. 20, 2000 (KR) ..... 10-2000-0041770
Jul. 22, 2000 (KR) ..... 10-2000-0042275

(51) Int. Cl.[7] ..... B65D 33/34
(52) U.S. Cl. ..... 220/707; 220/710; 229/103.1

(58) Field of Search ..... 220/705, 707, 220/708, 710, 709, 703, 713; 229/103.1; 383/80, 100

(56) References Cited

U.S. PATENT DOCUMENTS 4,448,316 A * 5/1984 Hiroshige ..... 215/388
4,669,124 A * 5/1987 Kimura ..... 383/80
4,718,778 A * 1/1988 Ichikawa ..... 383/100
4,852,762 A * 8/1989 Chou-Sheng ..... 220/709
5,065,909 A * 11/1991 Pino et al. ..... 222/484
5,520,304 A * 5/1996 Lin ..... 220/707

* cited by examiner

*Primary Examiner*—Joseph Man-Fu Moy
(74) *Attorney, Agent, or Firm*—Norris, McLaughlin & Marcus P.A.

(57) ABSTRACT

The present invention relates to a spout assembly for thin-film containers having an upper side end, a lower side end, a right side end, a left side end and a rounded corner side end comprising a fixing support fixed to the rounded corner side end, a spout portion extended from the fixing support to the outside of the container, a cap coupled with the spout portion, and a fluid guide member extended from the fixing suport to the lower side end of the container.

3 Claims, 9 Drawing Sheets

SPOUT ASSEMBLY FOR THIN-FILM LIQUID CONTAINER

TECHNICAL FIELD

The present invention relates to a spout assembly, and more particularly, to a spout assembly for thin-film liquid container.

BACKGROUND ART

Generally, containers using a pouch, or the like are not provided with a spout. As the user cuts the corner of the container, the user can drink the beverage through the cutting corner.

But, it is not convenient to draw thebeverage of the container because the cutting corner is easily shrunk and closed by an outer air pressure.

Therefore, a thin-film container having a spout is disclosed in a prior art so as to easily draw or dispense the beverage of the thin-film container. FIG. 12 shows a thin-film container having a spout assembly according to the prior art.

Referring to FIG. 12, the container C is provided with an upper end portion, a lower end portion, a right side portion and a left side portion. Further, the container C is provided at its corner with an inclined portion 11. The spout assembly 1 is fixed to a sealed surface of the inclined portion 11.

The spout assembly 1 comprises a fixing support 100 fixed to the sealed surface, a fluid guide member 13 vertically extended from the sealed surface to the interior of the container, and a spout portion(not shown) vertically extended from the sealed surface to the exterior of the container and coupled with a cap 200. That is, the spout portion and the fluid guide member 13 are formed along the longitudinal axis line X.

Therefore, the bottom end of the fluid guide member 13 is faced with the right side portion of the container along the axis line X. In this case, the liquid beverage of the container below the horizontal line L is not easily dispensed from the container owing to the shrink of the container C.

DISCLOSURE OF INVENTION

Therefore, the present invention has been made in an effort to solve the problem. It is an objective of the present invention to provide a spout assembly for thin-film containers and a thin-film container having a spout assembly that the user can easily and entirely sucks the beverage of the container.

It is another object of the present invention to provide a construction of a cap and a spout portion easily opening the spout assembly.

Further, it is still another object of the present invention to provide a spout assembly preventing the pollution of the spout portion.

To achieve the above objects, the present invention provides a spout assembly for thin-film containers having an upper side end, a lower side end, a right side end, a left side end and a rounded corner side end comprising a fixing support fixed to the rounded corner side end, a spout portion extended from the fixing support to the outside of the container, a cap coupled with the spout portion; and a fluid guide member extended from the fixing support to the lower side end of the container.

The rounded corner side end is tilted at a predetermined angle from the lower side end of the container, the fixing support is paralleled with the rounded corner side end, and the fluid guide member includes a first guide portion that is extended from the rounded corner side end and whose axis line intersects the right and left side ends and a second guide portion that is curved from the first guide portion at a predetermined angle and intersects the lower side end of the container.

The section of the fluid guide member is shaped of "+", or the fluid guide member is shaped of a straw.

The container is further provided with a cover member that covers the spout portion and the cap for preventing their pollution and is connected to the rounded corner side end where a cutting line is interposed.

The spout portion is integrally formed and coupled with the cap whereby the cap can be easily separated from the spout portion by one-touch manner.

The cap is formed at its bottom surface with a protrusion inserted into the interior of the spout portion so that the spout portion can be sealed again.

The spout portion has an elliptic section and the cap has a rectangular section so that the thickness of the spout assembly can be reduced.

The rounded corner side end has a horizontal corner end and a vertical corner end, the fixing support is fixed to the horizontal corner end and the fluid guide member is extended from the fixing support to the lower side end of the container.

The cap is provided with a wing knob for easily removing the cap from the spout portion.

BRIEF DESCRIPTION OF DRAWINGS

The accompanying drawings, which are incorporated in and constitute a part of the specification, illustrate an embodiment of the invention, and, together with the description, serve to explain the principles of the invention.

BEST MODE FOR CARRYING OUT THE INVENTION

A preferred embodiment of the present invention will be described in detail with reference to the accompanying drawings.

FIGS. 1 to 4 show a thin-film container having a spout assembly of the first embodiment of the present invention.

Figure 1:
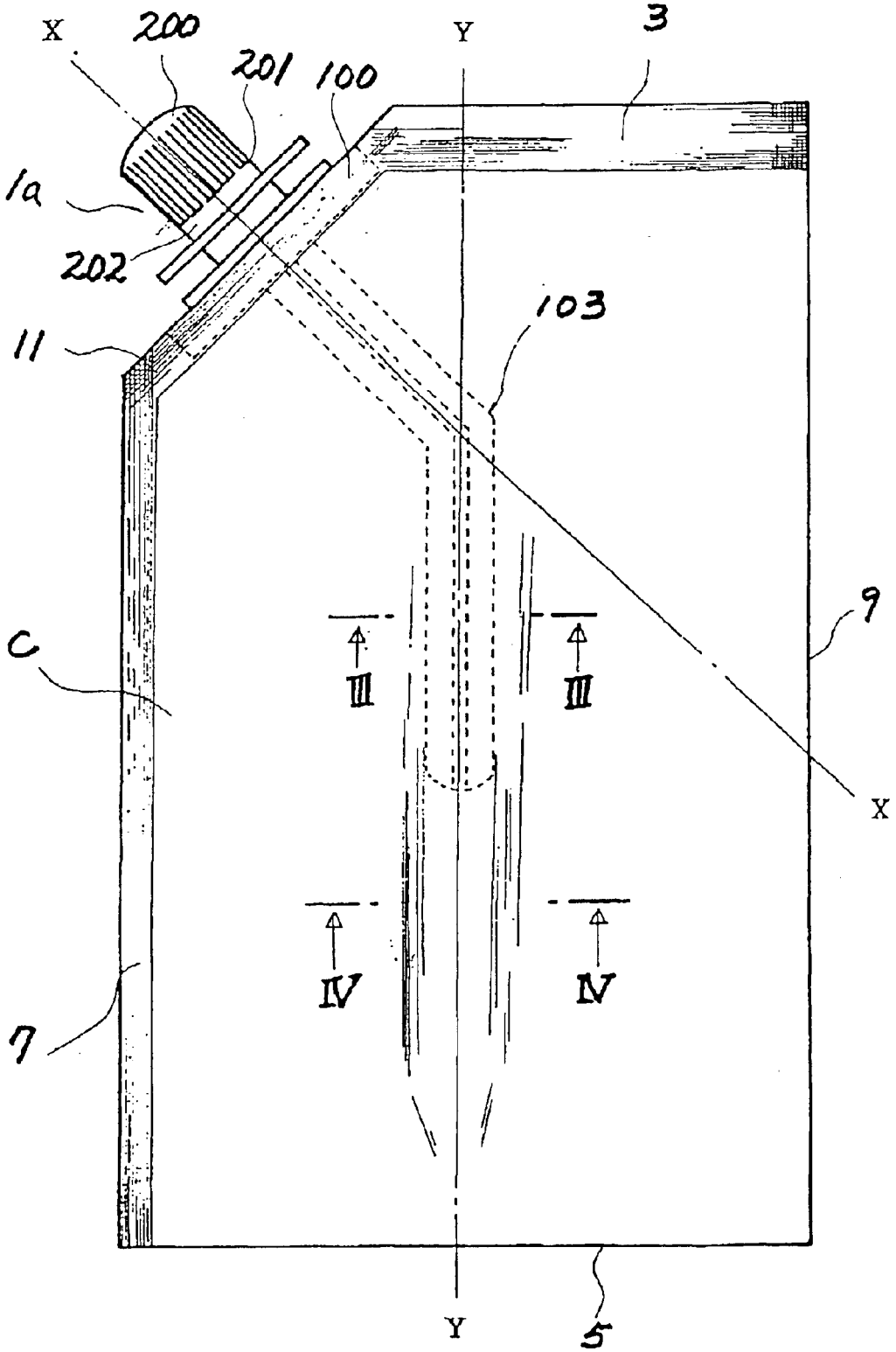
FIG. 1 is a front view a thin-film container having a spout assembly in a first embodiment according to the present invention.

Referring to FIG. 1, the thin-film container C has an upper side end 3, a lower side end 5, a right side end 9, a left side end 7 and a rounded corner side end 11.

Figure 2:
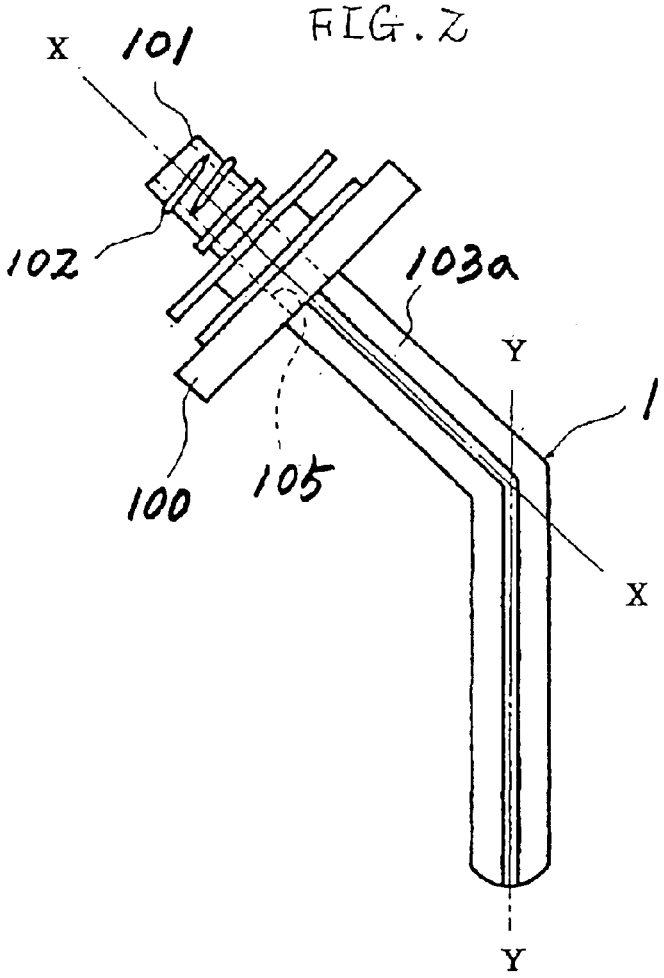
FIG. 2 is a front view a spout assembly of a first embodiment according to the present invention.

A spout assembly 1*a* of the first embodiment according to the present invention is fixed to the rounded corner side end 11 of the container C. As shown in FIG. 2, the spout assembly 1*a* comprises a fixing support 100 fixed to the rounded corner side end11, a spout portion 101 extended from the fixing support 100 to the outside of the container C and formed with a screw thread 102, and a fluid guide member 103 extended from the fixing support 100 to the lower side end of the container C. The fixing support 100 and the spout portion 101 is formed with an outflow hole 105 communicated with the fluid guide member 103 along an axis line X tilted at a predetermined angle with a vertical axis line Y of the container C.

The fluid guide member 103 includes a first guide portion 103*a* that is extended from the fixing support 100 along the axis line X, and a second guide portion 103*b* that is extended from the first guide portion 103*a* to the lower side end portion at a predetermined angle and intersects the lower side end 5 of the container C and faced with the lower side end 5 of the container C at a predetermined angle with respect to the axis line X.

Figure 3:
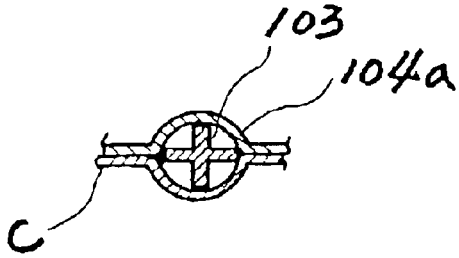
FIG. 3 is a sectional view taken along line III—III of FIG. 1.

The section of the fluid guide member 103, as shown in FIG. 3, is shaped of "+".

In this state, when opening a cap 200 threaded with the spout portion 101, a cutting line 201 is cut and a skirt 202 is removed from the cap 200.

Figure 4:
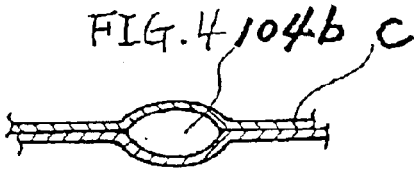
FIG. 4 is a sectional view taken along line IV—IV of FIG. 1.

At this point, when sucking the beverage through the spout portion 101, the container is shrunk and a first fluid guide hole 104*a* shown in FIG. 3 is formed with the second fluid guide portion 103*a* and the container. Further, as shown in FIG. 4, a second fluid guide hole 104*b* that communicates with the first fluid guide hole 104*a* is formed under the second fluid guide portion 103*a*. As a result, the beverage of the container C can be entirely dispensed through the first and second fluid guide holes 104*a* and 104*b* and the outflow hole 105.

Figure 5:
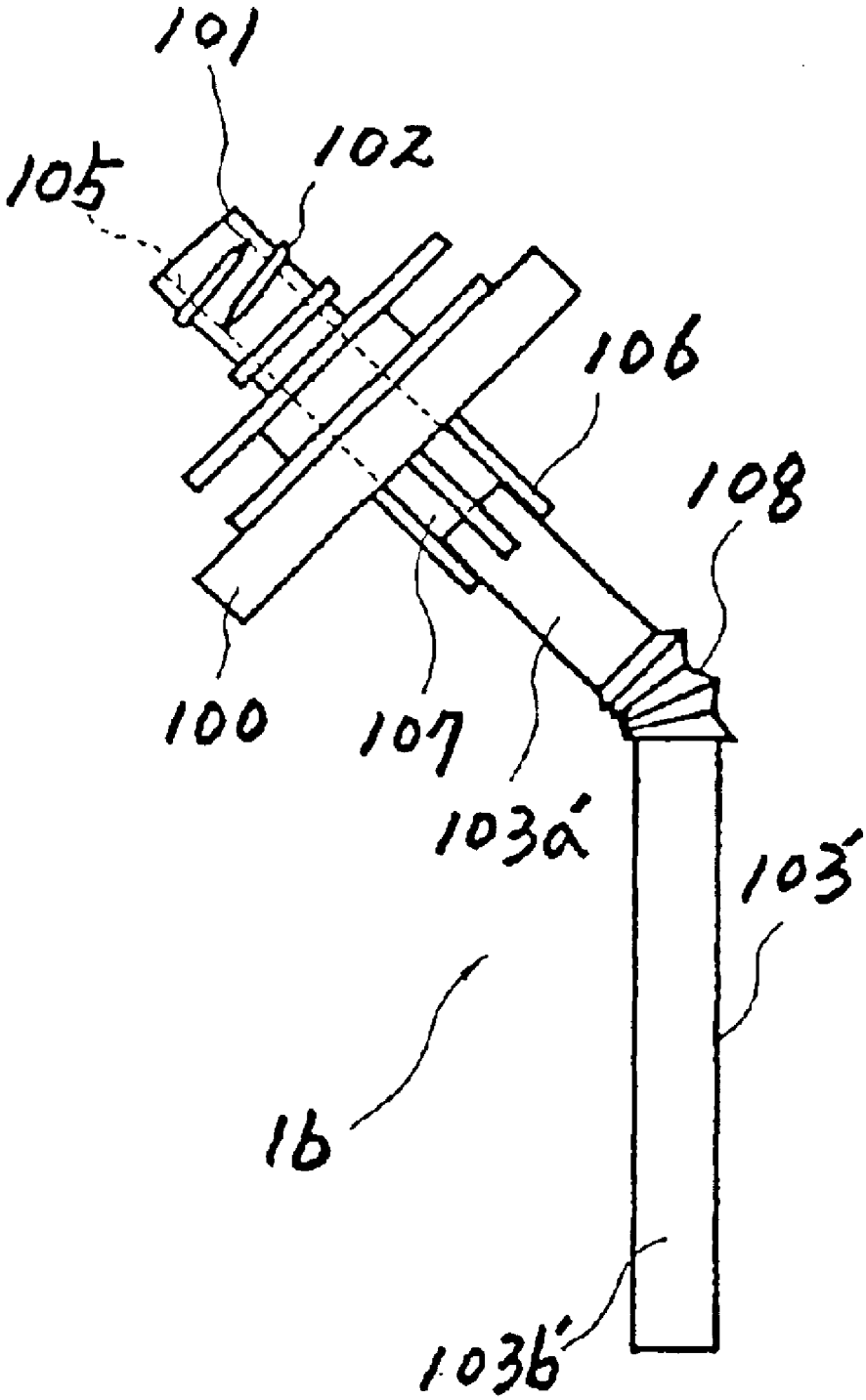
FIG. 5 is a front view of a spout assembly of the second embodiment according to the present invention.

FIG. 5 shows a spout assembly of the second embodiment according to the present invention.

In the second embodiment, the spout assembly 1*b* is provided with a fluid guide member 103' shaped of a straw. The fluid guide member 103' is formed with a pleated bending portion 108, a first fluid guide portion 103' and a second fluid guide portion 13*b*'. A guide member fixing support 106 for fixing the fluid guide member 103' is formed under the fixing support 100.

Figure 6:
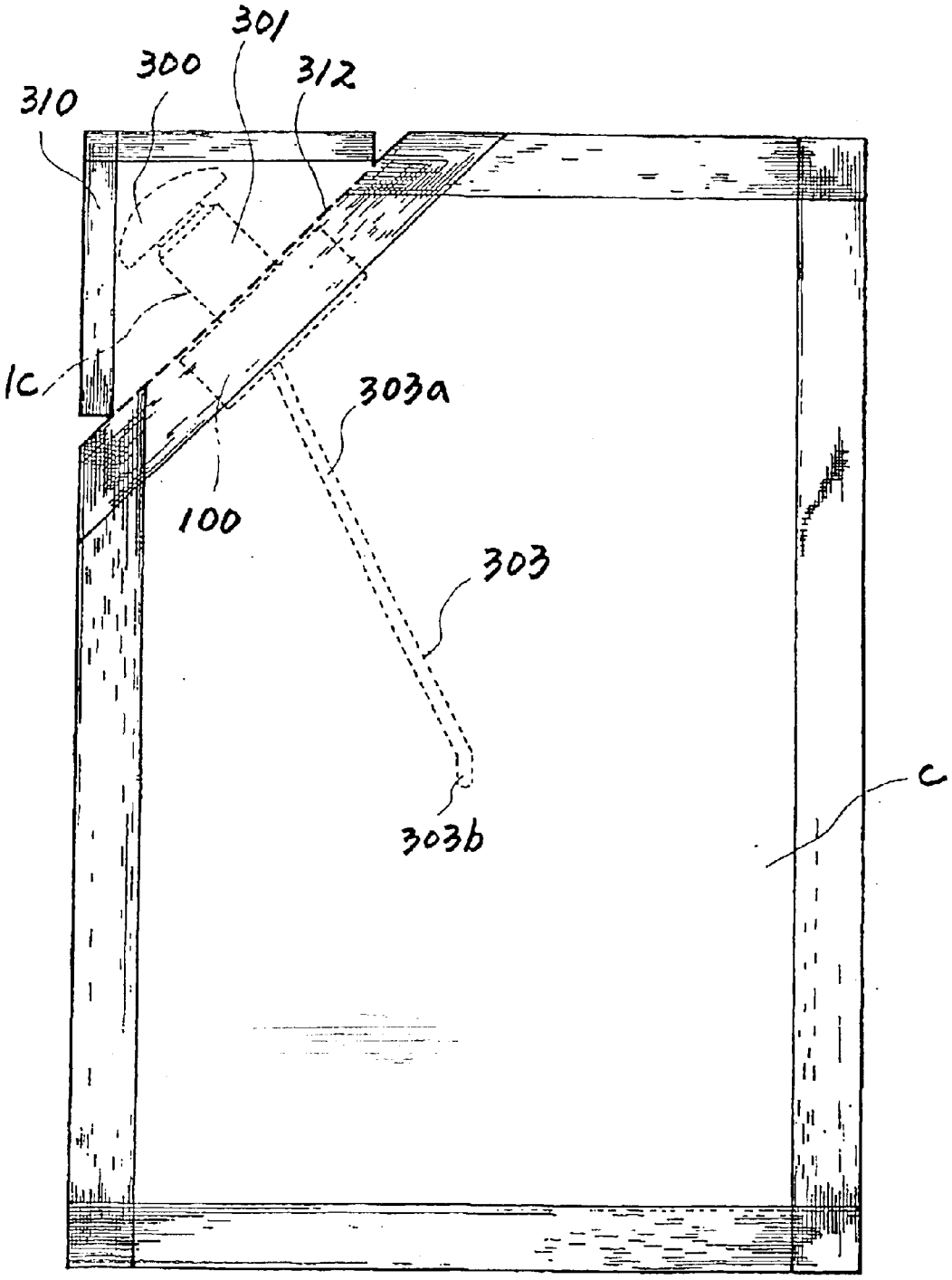
FIG. 6 is a front view of a thin-film container having a spout assembly of the third embodiment according to the present invention.
Figure 7:
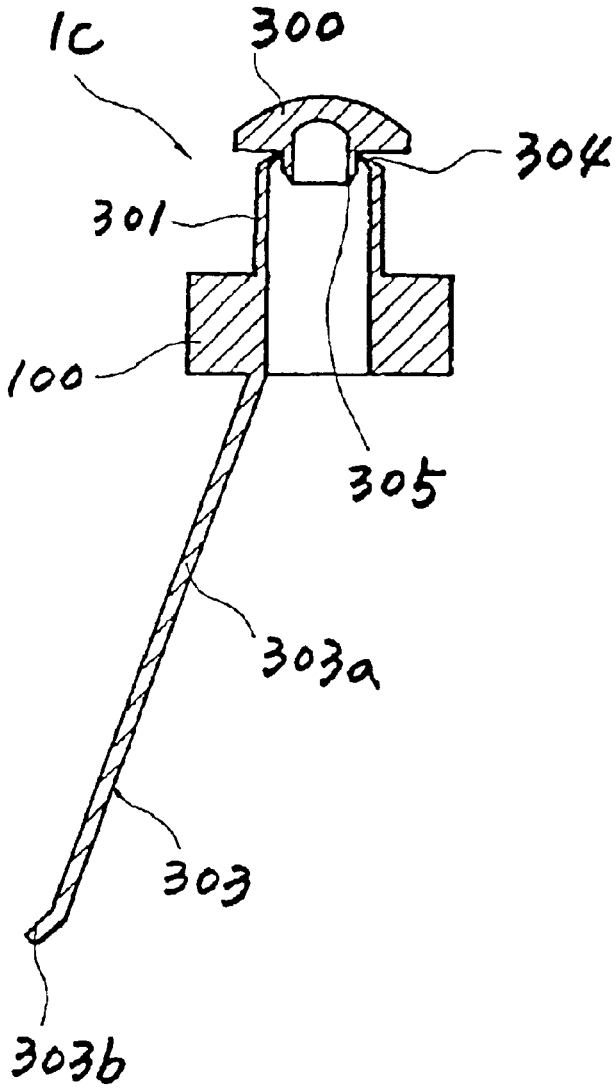
FIG. 7 is a sectional view of a spout assembly of the third embodiment according to the present invention.
Figure 8:
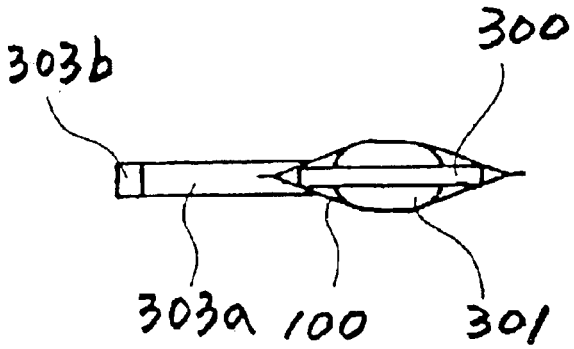
FIG. 8 is a plane view of a spout assembly of the third embodiment according to the present invention.

FIGS. 6 to 8 show a spout assembly of the third embodiment according to the present invention.

A spout assembly 1*c* is provided with first and second fluid guide portions 303*a* and 303*b* of a fluid guide member 303 and has a rectangular section.

The container C is further provided with a cover 300 that covers the spout portion 301 and the cap 300 for preventing their pollution and is connected to the rounded corner side end where a cutting line is interposed Further, as shown in FIG. 7, the spout portion 301 is integrally formed and coupled with the cap 300 whereby the cap 300 can be easily separated from the spout portion 301 by one-touch manner. The cap 300 is formed at its bottom surface with a protrusion 305 inserted into the interior of the spout portion 301 so that the spout portion 301 can be sealed again.

Referring to FIG. 8, the spout portion 301 has an elliptic section and the cap 300 has a rectangular section so that the thickness of the spout assembly 1*c* can be reduced and save space.

Figure 9:
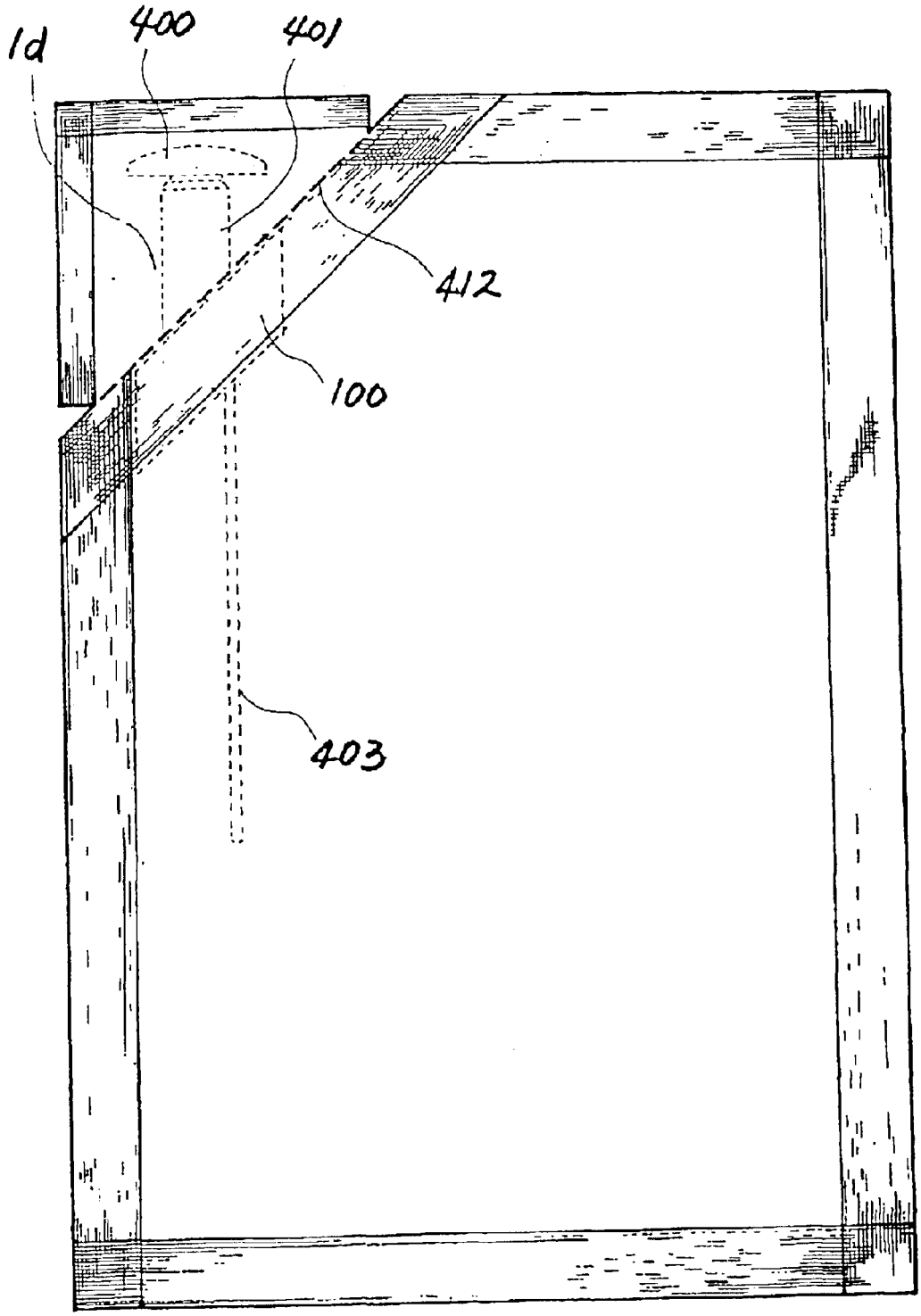
FIG. 9 is a front view of a thin-film container having a spout assembly of the fourth embodiment according to the present invention.

FIG. 9 shows a thin-film container having a spout assembly of the fourth embodiment according to the present invention.

In this embodiment, the construction of a spout portion 401 and a cap is similar that of the third embodiment. The spout portion 401 is upwardly extended from the fixing support 100 coupled to an inclined portion of the rounded corner side end, and a fluid guide member 400 is downwardly extended from the fixing support 100.

Figure 10:
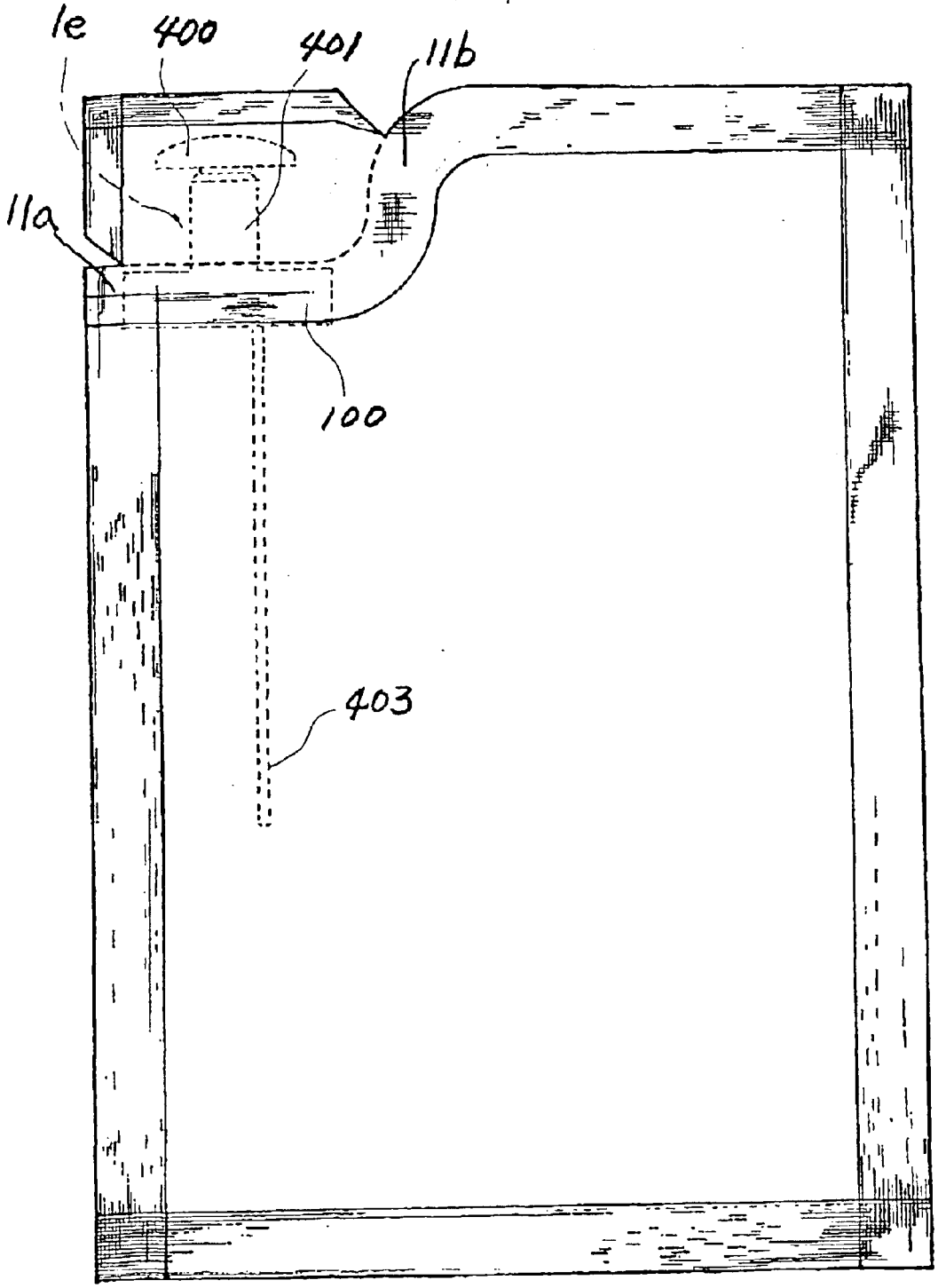
FIG. 10 is a front view of a thin-film container having a spout assembly of the fifth embodiment according to the present invention.

FIG. 10 shows a thin-film container having a spout assembly of the fifth embodiment according to the present invention.

In this embodiment, the spout assembly 1*e* is designed that the corner side end is composed of a horizontal end 11*a* and a vertical end 11*b*. The fixing support 100 is fixed to the horizontal end 11*a*.

Figure 11:
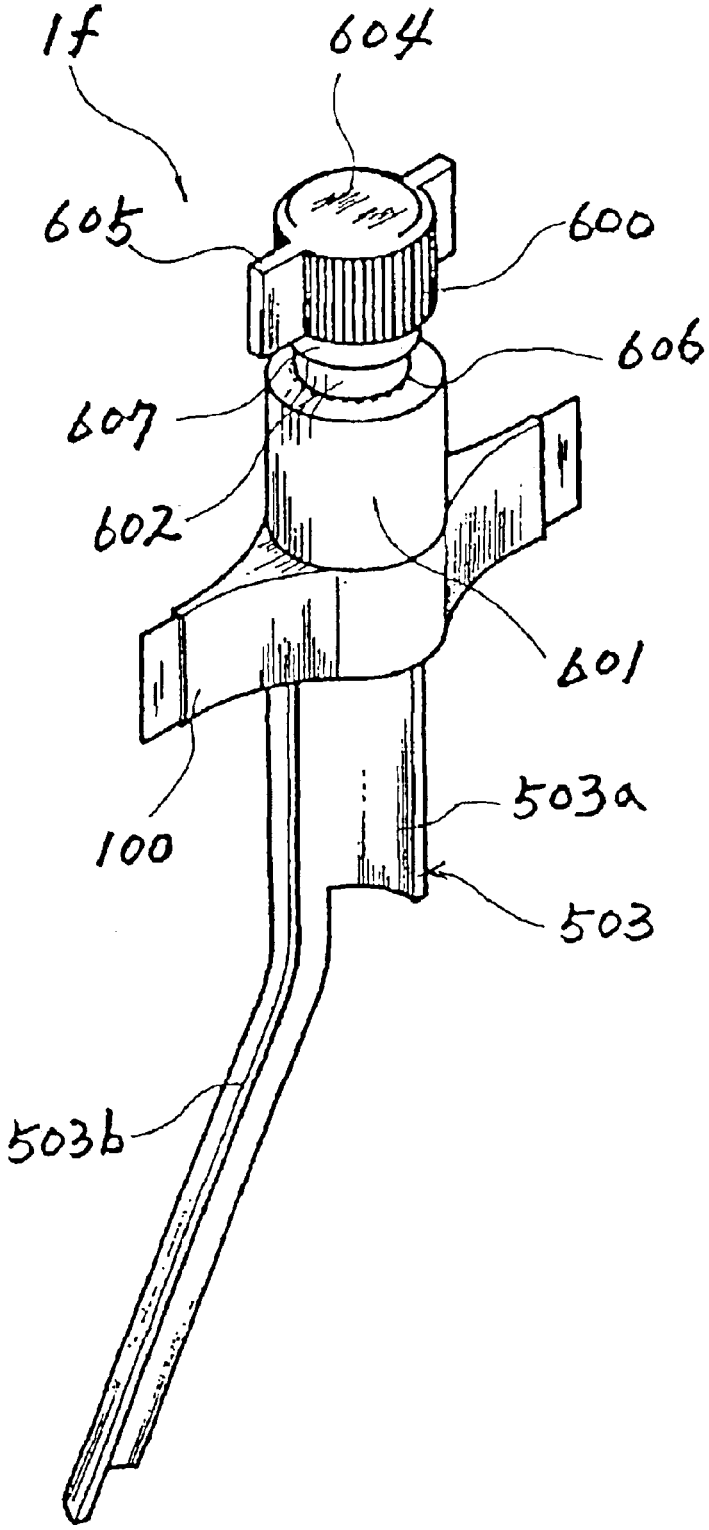
FIG. 11 is a perspective view of a spout assembly of the sixth embodiment according to the present invention.
Figure 12:
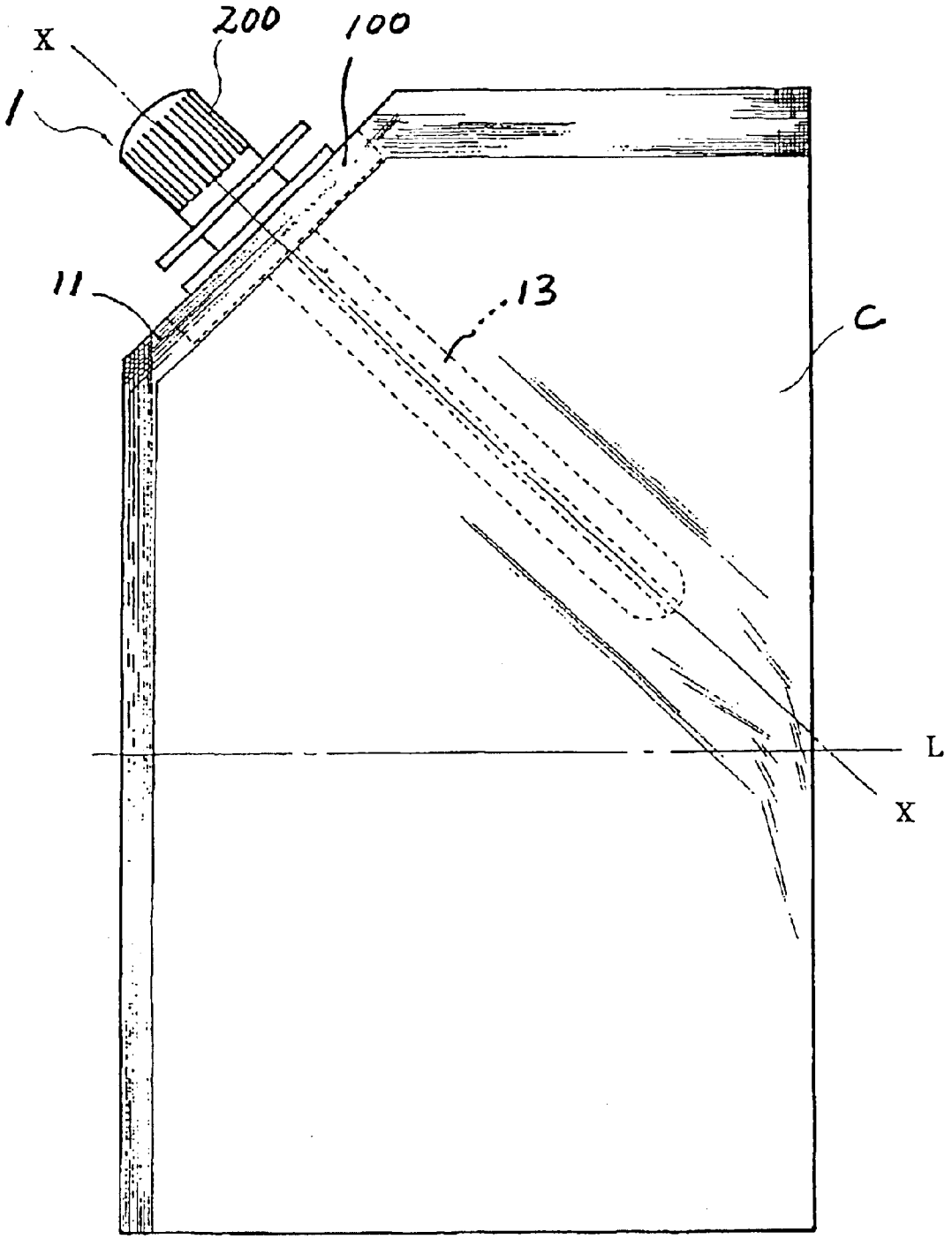
FIG. 12 is a front view of a thin-film container having a spout assembly of the prior art.

FIG. 11 shows a spout assembly of the sixth embodiment according to the present invention.

A spout assembly 1*f* is provided with a spout portion 601 upwardly protruded from a fixing support 2 and the fluid guide member 500 including a first guide portion 500*a* that is upwardly extended from the fixing support 2 and a second guide portion 500*b* that is curved from the first guide portion 500*a* at a predetermined angle and faces the lower side end of the container. The fluid guide member 500 is shaped of a side-open straw. A cap 604 is provided with a wing knob 605 for easily removing the cap 604 from the spout portion 601. The cap 604 is provided with a first seal portion 602 and a second seal portion 607.

While this invention has been described in connection with what is presently considered to be the most practical and referred embodiments, it is to be understood that the invention is not limited to the disclosed embodiments, but, on the contrary, is intended to cover various modifications and equivalent arrangements included within the spirit and scope of the appended claims.

What is claimed is:

1. A spout assembly for thin-film containers having an upper side end, a lower side end, a left side end and a rounded corner side end comprising:

a fixing support fixed to the rounded corner side end;

a spout portion extended from the fixing support to the outside of the container;

a cap coupled with the spout portion; and a fluid guide member extended from the fixing support to the lower side end of the container, wherein the rounded corner side end is tilted at a predetermined angle from the lower side end of the container, the fixing support is paralleled with the rounded corner side end, and the fluid guide member comprises a first guide portion that is extended from the rounded corner side end and whose axis line intersects the right and left side ends and a second guide portion that is curved from the first guide portion at a predetermined angle and intersects the lower side end of the container.

2. A spout assembly for thin-film containers as claimed in claim 1, wherein a section of the fluid guide member is shaped of "+".

3. A spout assembly for thin-film containers as claimed in claim 1, wherein the spout portion is formed at its outer circumference with a screw thread and the cap is formed at its inner circumference with a screw thread to be coupled with the screw thread of the spout portion.

* * * * *